US009441360B2

(12) United States Patent
Matteson

(10) Patent No.: US 9,441,360 B2
(45) Date of Patent: Sep. 13, 2016

(54) YIELD LINK FOR PROVIDING INCREASED DUCTILITY, REDUNDANCY, AND HYSTERETIC DAMPING IN STRUCTURAL BRACING SYSTEMS

(71) Applicant: Thor Matteson, Berkeley, CA (US)

(72) Inventor: Thor Matteson, Berkeley, CA (US)

( * ) Notice: Subject to any disclaimer, the term of this patent is extended or adjusted under 35 U.S.C. 154(b) by 0 days.

(21) Appl. No.: 14/607,680

(22) Filed: Jan. 28, 2015

(65) Prior Publication Data

US 2016/0208478 A1 Jul. 21, 2016

Related U.S. Application Data

(60) Provisional application No. 61/965,339, filed on Jan. 28, 2014.

(51) Int. Cl.
*E04C 3/00* (2006.01)
*E04B 1/41* (2006.01)
(Continued)

(52) U.S. Cl.
CPC . *E04B 1/40* (2013.01); *E04C 3/32* (2013.01); *E04B 2001/2448* (2013.01); *E04B 2001/2457* (2013.01); *E04C 2003/0404* (2013.01); *E04C 2003/0413* (2013.01); *E04C 2003/0417* (2013.01); *E04C 2003/0434* (2013.01);
(Continued)

(58) Field of Classification Search
CPC ..... E04B 2001/2457; E04B 2001/2448; E04C 2003/0417; E04C 2003/0434; E04C 2003/0465; E04C 2003/0447; E04C 2003/0456; E04C 2003/0452; E04C 2003/0413; E04C 2003/0404
USPC ..... 52/636, 653.1, 167.3, 837, 263, 831
See application file for complete search history.

(56) References Cited

U.S. PATENT DOCUMENTS 3,050,831 A * 8/1962 Diamond ..... B21D 47/04 29/897.31
3,283,464 A * 11/1966 Litzka ..... B21D 47/04 29/897.31

(Continued)

OTHER PUBLICATIONS

Matteson, Thor; "Soft Story Retrofits for the Real World: Cantilevered Column Modifications for Increased Ductility and Redundancy"; SEAOC 2014 83rd Annual Convention Proceedings, Sep. 2014; pp. 285-299; Structural Engineers Association of California; Sacramento, California.

*Primary Examiner* — Chi Q Nguyen
(74) *Attorney, Agent, or Firm* — Pate Baird, PLLC

(57) ABSTRACT

A yield link connection for use in bracing structures against lateral loads, the connection comprising a first structural member fixed to a base or foundation, and to which a yield link is connected. The yield link connects the first structural member to the structure in need of bracing. The yield link is created by cutting out a portion of material from a standard rolled steel structural section. The shape and dimensions of the cutout are designed so that the remaining elements of the yield link become separate bending elements. These separate elements behave as fixed-fixed members with predictable yielding, creating four plastic hinge zones around the cutout. High hysteretic damping is achieved through designing the cutout so yielding occurs in a large amount of the steel volume remaining adjacent to the cutout. The cutout is further designed so that yielding occurs in the yield link before it occurs in the first structural member. Clearance is provided between the first structural member and the yield link to limit relative movement between the members to a predetermined amount. Should the yield link need to be replaced after an episodic event, removal of the damaged yield link is easy compared to prior art.

4 Claims, 3 Drawing Sheets

(51) Int. Cl.
*E04C 3/32* (2006.01)
*E04C 3/04* (2006.01)
*E04B 1/24* (2006.01)

(52) U.S. Cl.
CPC ..... *E04C2003/0447* (2013.01); *E04C 2003/0452* (2013.01); *E04C 2003/0456* (2013.01); *E04C 2003/0465* (2013.01)

(56) References Cited

U.S. PATENT DOCUMENTS 3,927,499 A * 12/1975 Papayoti ..... E04B 1/19 52/263
3,963,099 A 6/1976 Skinner
4,038,799 A * 8/1977 Shanks ..... B63B 3/56 114/78
4,047,541 A * 9/1977 Mercier ..... E03C 1/046 137/564.5
4,263,762 A * 4/1981 Reed ..... E02D 27/02 52/169.1
4,516,874 A * 5/1985 Yang ..... F16B 5/126 403/313
4,793,113 A * 12/1988 Bodnar ..... E04B 2/58 52/481.1
5,519,977 A * 5/1996 Callahan ..... E04B 5/48 52/712
5,527,625 A * 6/1996 Bodnar ..... E04C 3/065 428/595
5,533,307 A 7/1996 Tsai
5,595,040 A 1/1997 Chen
5,630,298 A 5/1997 Tsai
5,664,380 A * 9/1997 Hsueh ..... E04B 2/7437 211/184
5,749,256 A * 5/1998 Bodnar ..... B21D 28/243 29/897.3
6,012,256 A 1/2000 Aschheim
6,138,427 A * 10/2000 Houghton ..... E04B 1/2403 52/236.3
6,199,336 B1 * 3/2001 Poliquin ..... E04B 2/58 52/261
6,301,854 B1 * 10/2001 Daudet ..... E04B 5/10 52/262
6,412,237 B1 7/2002 Sahai
6,681,538 B1 1/2004 Sarkisian
6,708,459 B2 * 3/2004 Bodnar ..... E04C 2/384 52/335
6,719,481 B2 * 4/2004 Hoffmann ..... F16B 7/18 403/13
6,739,562 B2 * 5/2004 Rice ..... E04B 2/7457 248/247
7,299,593 B1 * 11/2007 diGirolamo ..... E04B 2/58 52/241
7,739,850 B2 * 6/2010 Daudet ..... E04B 1/24 52/210
7,788,878 B1 * 9/2010 diGirolamo ..... E04B 2/58 29/897.3
7,874,120 B2 1/2011 Ohata
8,863,477 B2 * 10/2014 Stal ..... E04B 1/24 264/279
2005/0126105 A1 6/2005 Leek
2011/0308190 A1 12/2011 Pryor

* cited by examiner

YIELD LINK FOR PROVIDING INCREASED DUCTILITY, REDUNDANCY, AND HYSTERETIC DAMPING IN STRUCTURAL BRACING SYSTEMS

CROSS-REFERENCE TO RELATED APPLICATIONS

This application claims the benefit of U.S. Provisional Patent Application Ser. No. 61/965,339, filed Jan. 28, 2014, entitled "Cantilevered Structural Member Modified to Provide Increased Ductility and Redundancy, with Provisions for Dynamic Damping" which is hereby incorporated by reference in its entirety.

FEDERALLY SPONSORED RESEARCH (Not applicable)

SEQUENCE LISTING OR PROGRAM (Not applicable)

BACKGROUND

Field of Invention

This application relates to structural engineering, particularly lateral bracing systems to resist earthquakes or similar episodic forces.

Need

Structural engineers must often design structural members to resist large forces that may occur infrequently (such as earthquake forces) but whose failure would be catastrophic. Economy and reliability are both important considerations.

Many existing buildings throughout the world were constructed before the actions of earthquakes were understood and such understanding was applied to construction methods. The replacement value of existing buildings that are exposed to earthquakes in the city of San Francisco alone is 190 billion dollars. This includes over $100 billion in replacement value for wood-frame residential buildings that were built before construction methods provided adequate protection from earthquakes. Worldwide, the replacement value of buildings vulnerable to earthquakes is likely in the trillions of dollars.

One prominent vulnerability in existing buildings is the "soft, weak, or open-front" (hereinafter referred to as "SWOF") condition. A common cause of SWOF condition is a large storefront window or garage door opening that substantially reduces the availability of bracing elements in a building to resist horizontal earthquake forces. Maintaining the door opening or display space precludes certain types of strengthening measures such as diagonal braces or shear walls, which account for significant prior art in the general category of lateral force resisting systems.

Conventional Solutions

The two most common methods used to brace existing buildings with SWOF conditions are "moment-frames" and "moment-columns" (also called "cantilevered columns"). A moment-frame comprises two vertical members (usually one on each side of the large door or window opening) with a horizontal member rigidly connected to the tops of the vertical members. Moment-frames are almost always made of commonly available structural steel components. The members may be welded together in place—which presents the risk of fire—or bolted together. In almost all cases welding is required—which even if it is done in a fabrication shop adds substantial expense to the process.

Moment-frames are very difficult to fit into an existing building without first removing or relocating existing utilities such as water and gas piping, electrical wiring or conduits, sewer lines, ventilating ducts, etc. Sometimes the configuration of the building makes installation of a moment-frame impossible without making the garage door opening narrower or lower, or both.

Modern moment-frames have been tested fairly extensively and their performance in earthquakes is expected to be fairly predictable.

Moment-columns essentially act as very stiff flag-pole-like elements: the base of the moment-column is attached to, or embedded in, a solid foundation. The top of the column attaches to the structural framing above the SWOF condition to provide stability for the structure above. Like moment-frames, moment-columns are usually constructed using standard steel members. A moment-column generally consists of a single length of steel wide-flange or a hollow structural steel tube. One advantage that moment-columns have over moment-frames for strengthening existing residential constructions is that a single column location is often all that is needed to sufficiently strengthen the construction.

Moment-columns are not considered to perform as reliably in earthquakes as moment frames, especially when the structural system relies on only a single moment-column. Moment-frames also provide more structural redundancy; at least two regions of the moment-frame must yield before it fails catastrophically, versus a moment-column that would fail when the base of the column yields. Therefore the building codes in the US require that a moment-column system be designed for much greater earthquake forces than a moment-frame system, all other things being equal. This requirement is intended to create a safety factor which will assure that moment-columns will be no more prone to failure than moment-frames.

Moment-columns have two major drawbacks. First, they require large safety factors under the current building codes. Second, they are very difficult to replace once they have deformed during an earthquake—especially if they are embedded into a concrete foundation, which is the easiest way to install them.

Model building codes determine required safety factors based in part on the redundancy of a structural system. One such "safety factor" is known as the response modification factor, symbolized as R. The model building code used in the US tabulates values of R for various building systems: Moment-frames, cantilevered (moment) columns, light-frame construction with wood-panel shear walls, etc. Depending on the value of R assigned to a particular structural system, structural engineers must design for much greater forces for some systems.

Comparison of Moment-Columns to Other Bracing Methods

Consider two buildings that are identical except for the bracing systems; one building is braced with wood-panel shear walls and the other is braced with moment-columns. The seismic force that must be considered when designing the building braced with moment-columns will be from 2.6 to 5.2 times greater than the force for the shear-wall-braced structure. Compared to a structure braced with moment-frames, the design force for moment-column bracing may be as much as 6.2 times greater.

The weight required for a moment-column member is very closely related to the force it must resist. When a moment-column is being installed in an existing building it is generally impossible to lift members into place with an overhead crane. Reducing the weight of members to the point that workers can install them without using hoists would result in substantial reduction of construction costs.

Using a smaller safety factor would result in construction cost savings throughout the structural system, not just in the moment-column itself. The current model building code requires applying the safety factor for a moment column not just to the column itself, but also to all structural elements throughout the building that resist forces in the same direction as those resisted by the moment-column. This requirement implies at the very least doubling the strength of all components of the earthquake-force-resisting-system over what would be required for other systems.

Principles Affecting Performance

Bracing methods for buildings must be strong enough to resist the imposed loads. They must also provide sufficient stiffness to keep the structure from deforming under the imposed loads, otherwise excessive damage results. In some cases structural elements that are not part of the bracing system can fail if too much movement is allowed.

A moment-column fixed at its base will deflect laterally when a lateral load is imposed at the top. The amount of deflection depends largely on the height of the column, magnitude of the imposed load, column material, structural properties of the column, and the rigidity of the base connection and foundation. Structural connections that allow the column to lean, even slightly, before developing full resistance to the imposed load are not desirable. Base connections that allow any slip or yielding lead to the deflection being magnified by the height of the column. For example, consider a column of completely rigid material in the shape of a rectangular prism with sides one foot wide, and a height of eight feet. If the column is allowed to rock slightly before its base connection fully engages, the slight rocking is magnified by the ratio of the column's height to its width. In this case a yield link at the base of the column that elongates by ⅛ inch would result in the top of the column deflecting 1 inch. Placing a yield link as close to the top of the column as possible will reduce movement of the braced structure, thus reducing damage.

Back-up elements in a structural system that provide secondary load resistance increase the reliability of the system. Such elements are sometimes called "fail safe" mechanisms. In many existing buildings, back-up elements are provided by ignoring the strength of "non-structural" materials such as plaster and wall-board. Providing more reliable and purposefully designed elements would be beneficial.

Prior Art

Many existing constructions are built of "light-frame" materials, typically lumber framing members. These materials can provide adequate bracing when lateral loads are distributed over a sufficient number of members. Building materials used in most light-frame constructions do not lend themselves to bracing against highly concentrated lateral forces.

Structural steel members are well-suited to resisting concentrated forces that may be presented during earthquakes. Structural steel members and connections are commonplace in larger constructions such as high-rise buildings. Connections and members that resist hundreds of thousands of pounds or more are commonly made using various fabrication methods including bolting and welding. The great expense of such connections is justified in large buildings because relatively few of them are needed on a per-square-foot basis of building size. U.S. Pat. No. 7,874,120 B2 to Ohata et al (2011) and U.S. Pat. No. 6,681,538 B1 to Sarkisian (2004) claim connections that provide controlled yielding properties, but are prohibitively expensive for light-frame structures.

Prior Art

Shear Walls

Light framed constructions such as dwellings have included a number of bracing systems in the past. The method most frequently used in current light-framed construction is use of structural elements known as "shear walls." Shear walls are generally built on site using ordinary construction materials such as lumber, plywood, and nails. Shear walls require significant length along the sides of a construction to provide adequate lateral bracing. Large window or door openings are the very reason a SWOF condition exists in the first place; encroaching into the width of existing windows or doors to install shear walls changes the functionality of a building and is not an acceptable solution. Prior art has attempted to reduce the required bracing length of shear walls by introducing inventions of greater strength than could be achieved using ordinary construction materials. Even these improved systems do not have the strength required to resist high loads within the narrow confines of SWOF buildings. For example, commercially available products are manufactured under patent US20050126105 A1 to Leek, Perez, and Gridley (2005). The narrowest dimension manufactured is 12 inches. This product is rated to resist a lateral load of less than 1,000 pounds; demand can easily be 10 times this amount, making this product inadequate for bracing many existing constructions.

Besides relatively low strength, the products currently in production are generally available only in incremental sizes intended for new constructions. Existing buildings often require sizes that must be specially manufactured at greater expense, often resulting in construction scheduling delays.

Prior Art

Moment-Frames

As discussed earlier, moment-frames have features that make them completely unacceptable for use in many existing constructions and therefore are not considered as applicable prior art. One exception is the patent to Pryor and Hiriyur (2011) described in the following section.

Prior Art

Yield Links

Yield links are purposely designed to focus earthquake or other environmental forces into structural components specifically intended to absorb energy through the yielding of a ductile material such a steel. Ideally the yield links would be easily-replaceable structural components.

Ductile materials will yield in three ways: in shear, bending, or axially (due to tensile or compressive forces). Yield links using each of these principles exist in prior art.

U.S. Pat. No. 5,533,307 A to Tsai and Li (1996) uses triangular plates rigidly fixed along one edge and loaded at the opposite apex, orthogonally to the plane of the plate. This causes the plate to yield under bending stresses generally uniformly over the entire area of plate; bending stresses in the steel increase uniformly as distance increases from the point of applied load, as does the strength of the ever-widening plate section. This is known as the "Triangular-plate Added Damping and Stiffness" (TADAS) concept. Background for U.S. Pat. No. 5,533,307 A describes the original concept as "having significant drawbacks" in that it is difficult to fabricate and assemble; however, the system illustrated under that patent still requires expensive fabrication and welding, and would only be suited to bracing very large constructions.

A lateral bracing system under U.S. Pat. No. 3,963,099 A to Skinner and Heine (1976) uses a ductile member rigidly attached to a building foundation. The member extends vertically from a fixed base (foundation) to the underside of the superstructure of the building. The top of the member engages a bracket attached to the superstructure to transmit lateral forces to the foundation. This system is meant for situations where the superstructure and foundation are separated by only inches, and is thus not suitable where the superstructure that needs bracing is several feet above the foundation.

U.S. Pat. No. 5,630,298 A to Tsai and Wang (1997) uses plates configured to yield in shear, with various welded stiffeners and end plates. This system is also exceedingly complex for economical use in all but very large constructions.

Patent US20110308190 A1 to Pryor and Hiriyur (2011) shows a moment-frame connection that includes a yield link described as yielding in tension or compression. This link is used to connect a beam to a column in a moment-frame, and requires the use of a restraining member to prevent the link from buckling during compression loading. The buckling restraint and yield link configuration would be difficult to access if the yield link needed to be replaced.

Prior Art

Reduced Structural Sections

Engineers have learned the importance of inducing yielding of structural members at specific locations as a way to keep maximum bending stresses from occurring at vulnerable connections. One method of inducing yielding is the "reduced beam section" (RBS) method. In the RBS method, sections of flanges are cut away from a beam to reduce its strength by a predetermined amount. This method is described in U.S. Pat. No. 6,412,237 B1 to Sahai (2002) and U.S. Pat. No. 5,595,040 A to Chen (1997). A similar method is used in the patent to Pryor and Hiriyur (2011) cited above, wherein their yield link is created in the commercially available embodiment of their invention by reducing the stem in section of a "wide tee" shaped steel structural member or similar.

U.S. Pat. No. 6,012,256 A to Aschheim (2000) describes a method to reduce structural sections of members such that their webs will yield in shear at a predetermined loading level to protect more vulnerable structural components. This method does not expressly consider local buckling effects of the thin web elements that would remain adjacent to the voids in the modified member. Such buckling, if it occurred, could lead to sudden and possibly catastrophic failure of the member. Bracing the web elements would typically be done with welded stiffeners, which increases cost of fabrication.

SUMMARY

In accordance with one embodiment, a cantilevered connection method that includes a structural member modified by removal of portions of the member in such a manner as to induce yielding under predetermined loads, said structural member(s) being mounted to a second structural member and the superstructure of a building in a manner that provides bracing during an earthquake.

Advantages

Accordingly several advantages of one or more aspects are as follows: an economical and easy-to-fabricate connection, requiring no welding, providing an easily-replaceable yield link, improving the ductility and redundancy of the bracing system, providing for hysteretic damping, allowing bracing of structures with minimal disturbance to existing utilities or encroachment into wall openings, and a method to retrofit previously-strengthened buildings to provide some or all of the preceding advantages. Other advantages of one or more aspects will be apparent upon considering the drawings and description.

DRAWINGS

Reference Numerals

Figure 1:
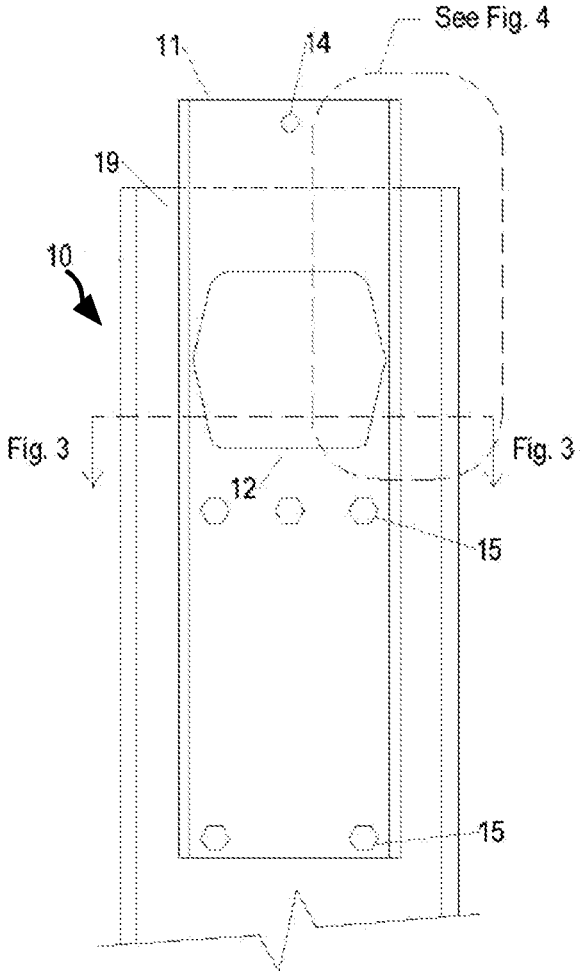
FIG. 1 View showing yield link assembled with cantilevered structural member FIG. 2*a* Yield link—one embodiment FIG. 2*b* Yield link—alternative embodiment FIG. 3 Section view of assembled yield links and structural member FIG. 4 Detail of cutout in yield link FIG. 5 Schematic diagram of "Fixed-fixed" bending member, with associated shear force and bending moment diagrams FIG. 6 Schematic diagram of "Fixed-pinned" bending member, with associated shear force and bending moment diagrams FIG. 7*a* Schematic diagram showing solid bending member with cutout in web FIG. 7*b* Schematic diagram showing solid bending member with cutout in web, deforming under lateral load FIG. 8*a* Schematic diagram showing a conventional moment-column subjected to lateral load FIG. 8*b* Schematic diagram showing deformation of moment-column subjected to lateral load

10 Column
11 Yield link
11*a* Yield link web
11*b* Yield link flange
12 Web cutout in yield link
13 Column connection hole
14 Framing connection hole

15 Connector
16 Narrowest remaining portion at cutout
17 Widest remaining web portion at cutout
17*a* Widest remaining web portion intended to yield
18 Inside radius
19 Clearance
30 Fixed-fixed member
30*a* Pseudo-column
31 Fixed end condition
31*a* Fixed end at pseudo-column
32 Fixed-pinned member
33 Pinned end condition

DETAILED DESCRIPTION

FIG. 1 shows one embodiment consisting of yield link 11 with web cutout 12 assembled to column 10 using connectors 15 through matching holes in yield link 11 and column 10 (the exact number and location of connectors 15 is not important to the invention). Framing connection hole 14 allows yield link 11 to be connected to the construction in need of bracing. Clearance 19 between link 11 and column 10 limits movement of link 11 with respect to column 10. Column 10 is attached at its base (not shown) by suitable means to provide relative fixity. The specific method of base attachment is not important to the present invention, and will be familiar to those possessing ordinary skill in the arts.

Figure 2A:
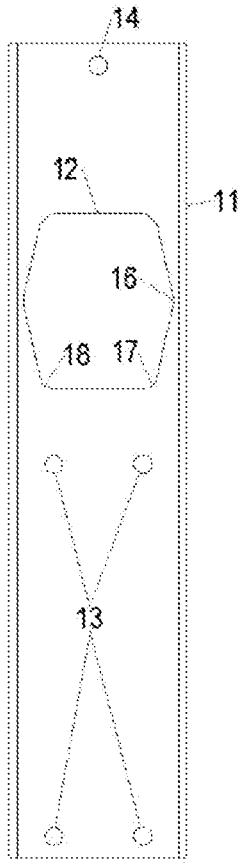
Figure 2B:
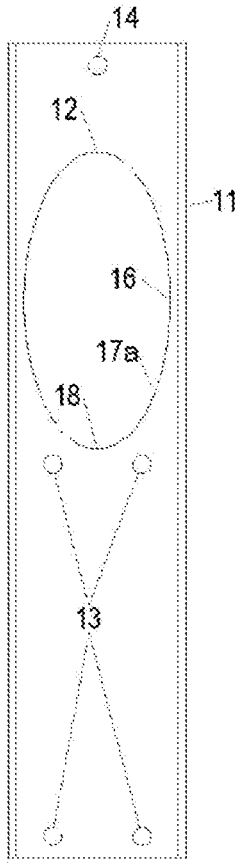

FIG. 2*a* and FIG. 2*b* show two embodiments of the yield link 11. Location of web cutout 12 is symmetric about the longitudinal axis of yield link 11. The shape of web cutout 12 shown is not intended to limit the shape of web cutout 12 in other embodiments.

Placement of column connection holes 13 and framing connection hole 14 are not important to the present invention, and their location and number will vary. Connection requirements can be determined by those possessing ordinary skill in the arts.

Length of yield link 11, along with the shape and location of web cutout 12 are very important to proper performance. These properties are subject to the brace loading, geometry and dimensions of the particular construction in which the present invention is installed, based on further explanation that follows.

Figure 6:
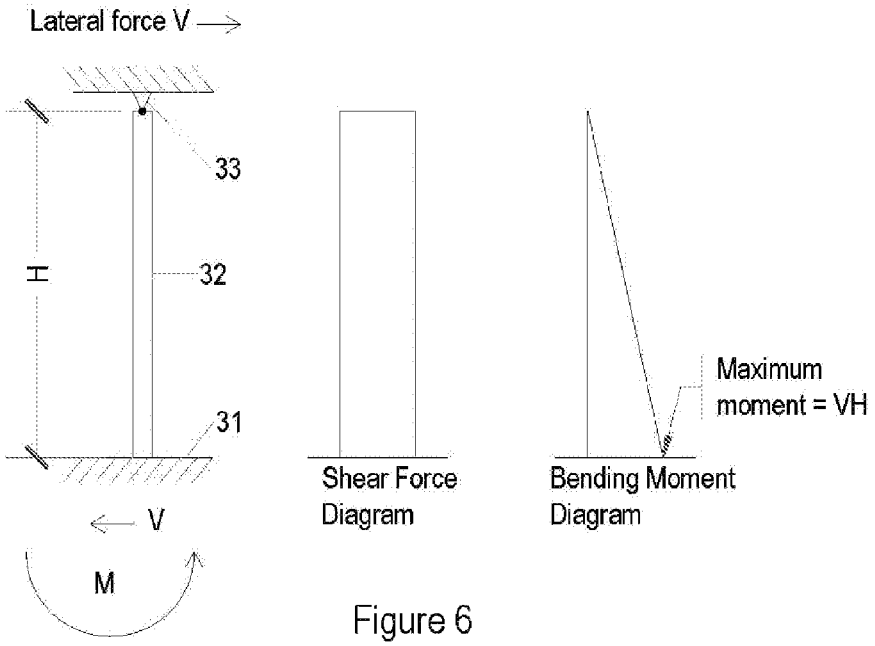

The shape and dimensions of web cutout 12 depend on the material of which yield link 11 is made, allowable lateral displacement, and other factors. These determinations can be made by those possessing ordinary skill in the arts, considering at least the following:

Yield link 11 and web cutout 12 must be designed such that yield link 11 will yield prior to yielding occurring in column 10. A conventional cantilevered column would yield at the point of maximum moment as indicated in FIG. 6. A suitable safety factor must be applied as prudent or required by applicable codes.

(See also FIG. 3) The widest remaining portion at cutout 17 must be restricted such that local buckling of yield link web 11*a* does not occur (or a standard steel member for yield link 11 is selected with a thicker web 11*a*). As an alternative (not shown) an element or system could be provided that would restrain web 11*a* from buckling. Narrowest remaining portion at cutout 16 would need to be minimized to the thickness of yield link flange 11*b* to maximize yielding of the material remaining on either side of web cutout 12.

Figure 7A:
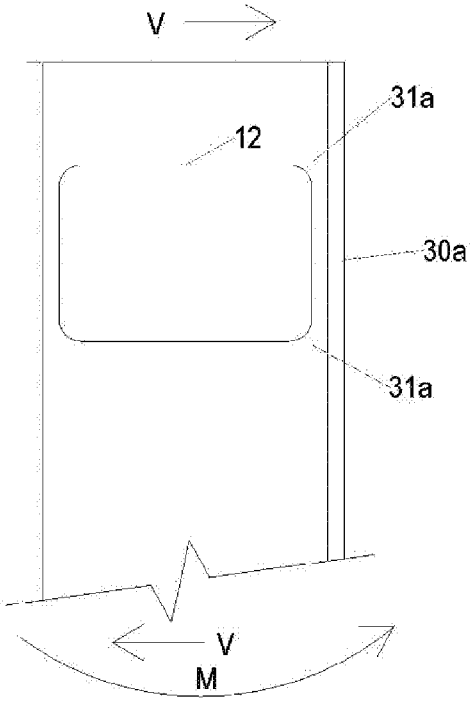

Dimension of web cutout 12 along the longitudinal axis of yield link 11 will depend on the allowable lateral movement of the structure to be braced in accordance with relevant building codes. Lateral movement must also be limited so that bending strain in the material remaining on either side of web cutout 12 does not lead to low-cycle fatigue failure of the material used for yield link 11. Strains will be reduced if the dimension of web cutout 12 is increased along the longitudinal axis of yield link 11. The moment in the overall section increases closer to the fixed attachment point (see FIG. 6). Greater moment induces greater local compressive or tensile bending stress in flanges 11*b* due to overall bending moment acting on the gross section of yield link 11. Location and length of web cutout 12 must consider buckling of the pseudo-columns 30*a* as shown in FIG. 7*a*.

The preceding determinations are more fully described in "Soft Story Retrofits for the Real World: Cantilevered Column Modifications for Increased Ductility and Redundancy" by Thor Matteson, SE and Justin R. Brodowski, MS, EIT, Structural Engineers Association of California, 2014 Convention Proceedings.

FIG. 2*b* shows an embodiment where web cutout 12 extends beyond the "effective" widest remaining web portion intended to yield 17*a*. This configuration may be effective in further reducing stress concentrations around web cutout 12.

Figure 3:
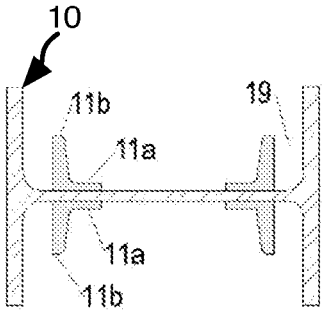

FIG. 3 shows a section view of two yield links 11 sandwiching a column 10. One yield link 11 is secured on each side of column 10 (represented here as a wide-flange member). This figure illustrates yield link web 11*a* and yield link flange 11*b*, as well as clearance 19. Clearance 19 may be provided so a pre-determined lateral movement of the upper portion (as shown in figures) of yield link 11 will cause flange 11*b* to contact the inside face of flange of column 10. This would provide further structural redundancy in the case that the yield link 11 failed.

Figure 4:
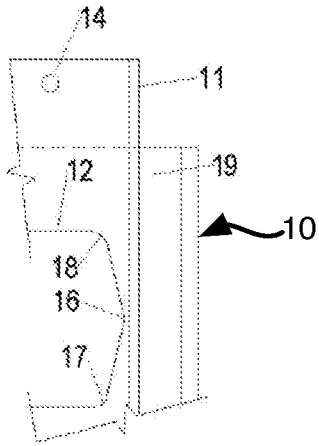

FIG. 4 shows a detail area of the web cutout 12 following the general shape of the embodiment illustrated in FIG. 2*a*. Inside radius 18 is intended to reduce stress concentration at the transition from web cutout 12 to intact section of yield link 11.

Figure 5:
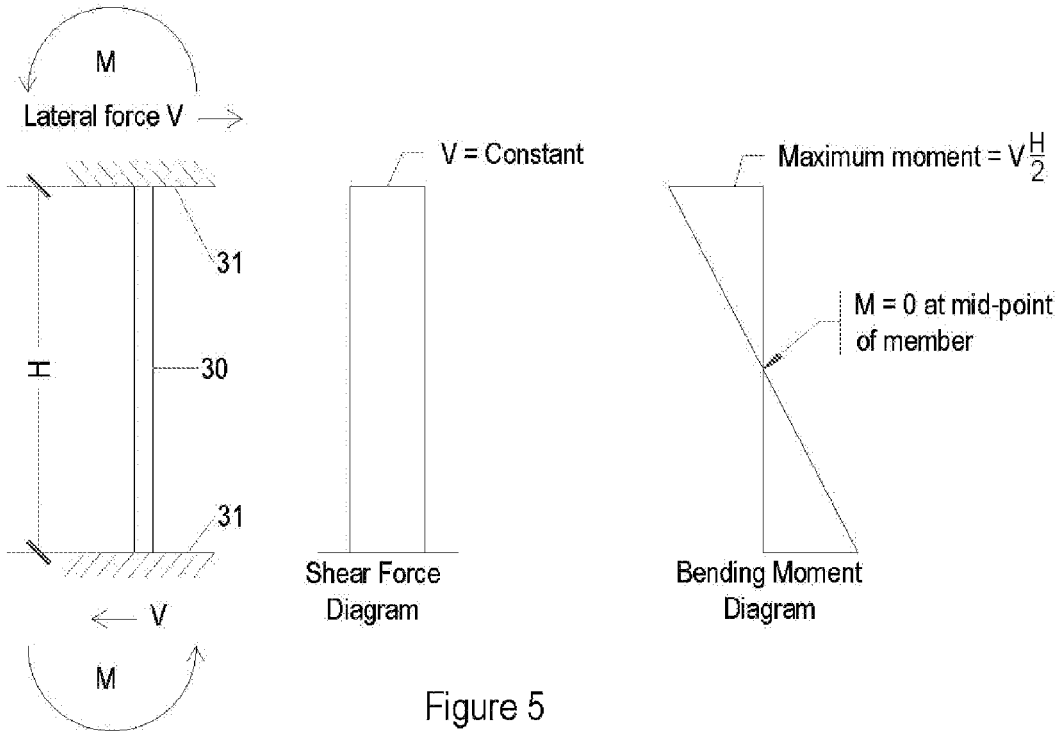

FIG. 5 shows a representative fixed-fixed member 30 with fixed end conditions 31 at both ends, with a lateral load "V" applied at the connected ends. The associated shear force and bending moment diagrams are given for the member under the loading shown.

FIG. 6 shows a representative fixed-pinned member 32 with fixed end condition 31 at the bottom of the figure and pinned end condition 33 at the top of the figure. A lateral load "V" is applied at the connected ends and the associated shear force and bending moment diagrams are shown for the given loading.

FIG. 7*a* shows a schematic member as used for the yield link. This would be an ordinary bending member except for the web cutout 12, which creates two pseudo-columns 30*a* on either side of web cutout 12. The pseudo-columns 30*a* both take on the behavior of fixed-fixed member 30 as shown in FIG. 5. Adjusting the dimensions of web cutout 12 allows great control over determining the lateral load that induces yielding, and where the yielding occurs. Yield link 11 has four regions that will undergo yielding because of web cutout 12, namely above and below the midpoint of pseudo-columns 30*a* shown in FIG. 7*a*. If an unmodified section (from which web cutout 12 was removed) deformed due to bending stresses, it would result in the yield link flanges 11*b* yielding only in tension or compression. Providing yield links 11 on both sides of column 10 (as shown in FIG. 3) gives eight distinct regions that will undergo yielding, compared to two regions in a conventional moment column. This is a significant increase in system redundancy.

Figure 7B:
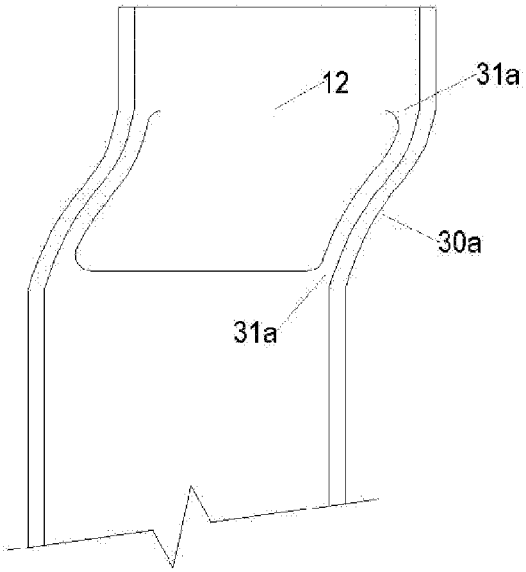

FIG. 7*b* illustrates how the member in FIG. 7*a* would deform under load.

Figure 8A:
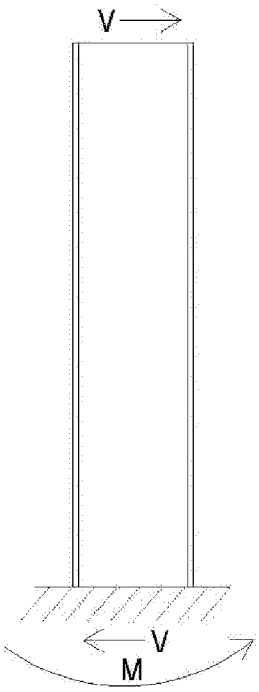
Figure 8B:
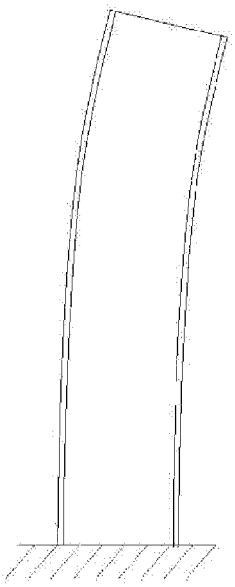

FIG. 8*a* shows a conventional moment-column under load; FIG. 8*b* shows how the same column would deform. Such deformation would lead to the left side of the column yielding in compression and the right side yielding in tension (typical behavior for a bending member). Comparing FIGS. 8*a* & 8*b* and FIGS. 7*a* & 7*b*, we see that the configuration of the present invention leads to reverse-curvature bending in the elements adjacent to the web cutout. Since yielding takes place in four discreet regions instead of two, the present invention has much greater structural redundancy than a conventional bending member.

Operation:

The operation of the present invention is essentially the same as a conventional moment-column, save for replacement of yield link(s) 11. Referring to FIG. 1, a structural member is provided with a rigid connection at its base (represented as column 10). Identical yield link(s) 11 are attached to both sides of the web of column 10 using appropriate connectors 15. The structure to be braced is connected to yield link(s) 11 through framing connection hole 14. If an earthquake or other episodic event creates sufficient force in the yield link(s) 11 to cause them to deform, connectors 15 may be removed to allow replacement of link(s) 11.

The present invention may be used to strengthen buildings or other structures against forces induced by other than earthquakes, and it may be used in new construction, and/or may include materials other than steel, in alternative embodiments of the invention.

CONCLUSION, RAMIFICATIONS, AND SCOPE

The yield link connection presented allows a versatile method to induce controlled yielding at predetermined loads. Such yielding can absorb large amounts of energy through hysteretic damping, offering protection to the braced structure above.

Additional advantages to the present invention include:

- The yield link(s) can be formed from rolled steel sections that are available worldwide in a large variety of sizes and thicknesses.
- Hysteretic damping can be achieved efficiently by designing the yield link to simultaneously yield along the height of web cutout.
- Provides up to four times as many discrete yield zones as compared to a conventional moment-column.
- Further testing could allow significant reductions in design forces required by model building codes for this system, based on increased ductility and redundancy. Such reduction would make this system much more economical to install than current moment-columns.
- Using a moment column allows greater flexibility in locating the bracing system than does a moment-frame.
- Selecting appropriately matched column and yield link to give a desired clearance between their flanges allows for a maximum deflection at which point a "fail-safe" limit in yielding of yield link occurs
- The yield link can be easily replaced if they are damaged during episodic loading.
- Requires no welding, resulting in reduced costs and elimination of related fire hazards in cases where field welding would otherwise be needed.
- The yield link is relatively light-weight and easily handled in a fabricator's shop, facilitating economical fabrication
- Yield links can be paired with supporting columns to provide a wide variety of clearance between link and column. This allows for designing a variety of strengths and deflections that the system permits.

Under current building code requirements, conventional moment columns are severely restricted in practical use. The present invention is expected to provide ductility and redundancy that would allow using column systems to brace a much wider range buildings. Using this method could save substantial construction costs in millions of buildings currently vulnerable to earthquakes.

I claim:

1. A lateral bracing system used in constructions, the lateral bracing system being capable of mounting to a first surface at a first end and capable of mounting to a second surface at a second end, the lateral bracing system comprising:

a first member including a first rolled structural member including a first web as a central portion of at least one of a "W," "H" or "C" shape, a first long axis of the first member being oriented vertically, the first member being connected to the first surface;

a second member including a second rolled structural member oriented having a second long axis parallel to the first long axis of the first rolled steel structural member, having a planar portion as a second web of the second member in mating contact with the first web of said first member and having a fixed connection to the first web of said first member, having a pinned connection to the second surface, and having material removed to form a void in the second web the second web being sized such that forces acting perpendicular to the long axis of the first and second members and acting substantially parallel to the second web result in portions of material of the second member remaining on either side of the void yielding primarily in bending of the material of the second member remaining on either side of the void, based on structural sections of the material remaining on either side of the void rather than gross section properties of the second member without said void;

wherein the second member is captured between projecting elements of the first member such that movement of the second member is limited by the projecting elements of the first member;

wherein the void in the second member is sized in a manner that causes the second member to yield under a predetermined magnitude of applied lateral force, such force being lower than that which would cause the first member to yield and;

a third member, substantially identical to the second member, to include a void therein, is attached to an opposite side of the first member, the second and third members being aligned and sandwiching the first member having the voids in the first and third members sized such that yielding occurs in the second and third members together before yielding occurs in the first member.

2. The lateral bracing system as recited in claim 1, wherein the first long axis and second long axis are not oriented vertically, and the first and second surfaces to which the bracing system attaches are positioned at opposite ends of the bracing system.

3. The lateral bracing system as recited in claim 2, wherein one or more of the first and second members is composed of a material other than steel.

4. The lateral bracing system as recited in claim 1, wherein one or more of the first, second, and third members is composed of a material other than steel.

* * * * *